US005687516A

United States Patent [19]

Sheehan et al.

[11] Patent Number: 5,687,516

[45] Date of Patent: Nov. 18, 1997

[54] PARKING SPACE CENTERING DEVICE FOR MOTOR VEHICLES

[76] Inventors: Michael P. Sheehan, 2675 S. Columbine St., Denver, Colo. 80210; James W. Wanek, 6871 E. Eagle Pl., Highlands Ranch, Colo. 80126

[21] Appl. No.: 648,208

[22] Filed: May 14, 1996

[51] Int. Cl.[6] ..... E01F 9/00; E04H 6/42

[52] U.S. Cl. ..... 52/174; 188/32; D12/217

[58] Field of Search ..... 52/174; 188/32; D12/217

[56] References Cited

U.S. PATENT DOCUMENTS

| | | | |
|---|---|---|---|
| D. 315,542 | 3/1991 | Dalton et al. | D12/217 |
| D. 350,525 | 9/1994 | Robinson | D12/217 |
| 1,893,580 | 1/1933 | Colley | 188/32 |
| 2,129,503 | 9/1938 | Mulieri | 188/32 |
| 2,497,565 | 2/1950 | Stark . | |
| 2,655,225 | 10/1953 | Harris | 188/32 |
| 2,746,571 | 5/1956 | Taylor | 188/32 |
| 2,938,602 | 5/1960 | Horrocks . | |
| 2,996,150 | 8/1961 | Cassem . | |
| 3,113,642 | 12/1963 | Lay | 188/32 |
| 3,661,227 | 5/1972 | Robel et al. . | |
| 4,246,982 | 1/1981 | Pretnick . | |
| 4,497,147 | 2/1985 | Clapper et al. . | |
| 4,671,024 | 6/1987 | Schumacher . | |
| 4,798,754 | 1/1989 | Tomek . | |
| 5,090,588 | 2/1992 | Van Romer et al. . | |
| 5,128,189 | 7/1992 | Bartlett . | |
| 5,226,559 | 7/1993 | Czajkowski et al. . | |
| 5,270,089 | 12/1993 | Alston . | |
| 5,383,639 | 1/1995 | Byard | 188/32 X |
| 5,478,625 | 12/1995 | Wright . | |

*Primary Examiner*—Christopher T. Kent
*Attorney, Agent, or Firm*—John E. Reilly

[57] ABSTRACT

A stand-alone centering device is provided for residential and commercial parking spaces to assist a motor vehicle operator in centering the motor vehicle in the space, the device consisting of a resilient floor marker which can be adhesively secured at or near an entrance end of the parking space and positioned such that the motor vehicle operator must align the left or right front tire of the vehicle to roll over the marker followed by the left or right rear tire of the vehicle in order to establish proper alignment of the vehicle in centered relation to the space. An additional marker may be positioned in predetermined relation to the front end of the space to indicate the forward end limit of travel.

13 Claims, 1 Drawing Sheet

PARKING SPACE CENTERING DEVICE FOR MOTOR VEHICLES

BACKGROUND AND FIELD OF INVENTION

This invention relates to centering devices for vehicles; and more particularly relates to a novel and improved floor marker for assisting a vehicle operator in parking his or her motor vehicle or non motorized vehicle in a parking space.

In parking areas or garages, whether residential or commercial, space is at a premium. If each vehicle is not properly centered in a space, it can result in other vehicles parking too close to the first vehicle and, in some instances, prevent utilization of an adjacent space. Thus, a common problem in commercial parking garages in parking too close to one another is denting or "dings" caused by insufficient space between vehicles in which to open the vehicle door for ingress and egress to and from the vehicle. A similar problem exists in residential garages designed for occupancy of two or more vehicles not only in parking in proper spaced relation to one another but in relation to the front wall or sides of the garage.

In the past, floor chocks have been devised for positioning on the garage floor near the front end wall of the garage to serve as a stop for one or both of the front tires of a vehicle and prevent collision or bumping either into the end wall or articles located against the wall, for example, as disclosed in U.S. Pat. Nos. 5,090,588 to Van Roamer et al, 4,497,147 to Clapper et al and 5,226,559 to Czajkowski et al. Vehicle drip mats have been devised with curbs or stops at the front end of the mats to indicate to the motor vehicle operator when the front tires of the vehicle have reached the front end of the mat and, for example, reference is made to U.S. Pat. Nos. 5,270,089 to T. E. Alston et al, 4,246,982 to G. Pretnick and 5,478,625 to D. M. Wright. Among other problems inherent in curbs or stops of the type devised in the past is that they do not adequately serve as an alignment aid at the entrance to the parking space and are not designed such that the vehicle cannot roll over the device as it enters the space; or in the case of vehicle drip mats is directly associated with the mat which is intended to be located near the front end of the vehicle and not at the entrance area.

In properly steering a motor vehicle into a parking space, the most critical point is the entry point of the front tires so that if the vehicle is not properly centered as it enters the space can make an immediate correction by backing up and realigning the vehicle. In other words, realignment is much more difficult and time-consuming if the motor vehicle operator has already entered the space before learning that it is not properly centered in the space. It is also desirable that the centering device be so constructed and arranged that it can be adjusted with respect to the floor surface in the event that trial and error is required to properly locate the device and then securely affixed to the floor; yet the device must be raised a sufficient distance above the floor to create a noticeable bump or jog when a tire rolls over the device but without unduly tilting the motor vehicle. Furthermore, it is desirable that the devices can be used singly or in pairs depending upon the particular requirements of a parking space to limit or retard forward movement of the vehicle into a space.

SUMMARY OF THE INVENTION

It is therefore an object of the present invention to provide for a novel and improved centering device for parking spaces which is highly reliable and efficient in use.

Another object of the present invention is to provide for a novel and improved parking space centering device in the form of a floor marker stationed at the entrance area to a parking space to guide a motor vehicle into centered relation to the space.

It is a further object of the present invention to provide for a novel and improved centering device which is conformable for use in residential or commercial parking garages and spaces which is of simplified, low-cost construction, easy to install, lightweight, and compact while presenting minimal obstruction to a vehicle in rolling over the centering device into a parking space.

In accordance with the present invention, a centering device for guiding motor vehicles into a parking space comprises a resilient body of a length greater than a width dimension of a tire on the motor vehicle, the body being of a height substantially less than the radial dimension of the tire and having side walls merging upwardly toward one another from a common base together with securing means for securing the body to a floor surface of the parking space for extension transversely of the direction of travel of the motor vehicle and near an entrance end of the floor surface so that successive movement of a front tire of the motor vehicle followed by a rear tire of the motor vehicle over the body will establish alignment of the motor vehicle in centered relation to the parking space. Preferably, the resilient body is a low-profile elongated extrusion with spaced adhesive strips along the base which define the securing means for firm but releasable contact to the floor surface; and the body may be used singly or in pairs at the entrance and opposite ends of the space.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
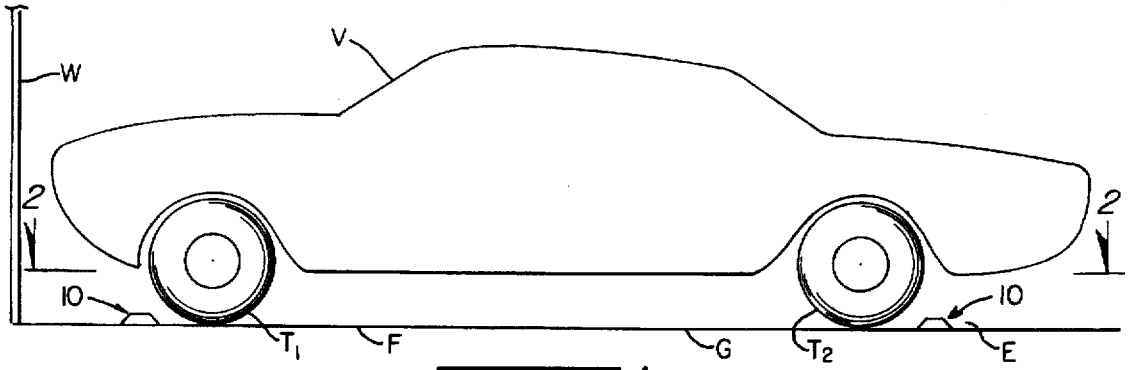
FIG. 1 is a side view in elevation of a pair of centering devices disposed in fore and aft relation to one another in a parking area in accordance with the present invention.
Figure 2:
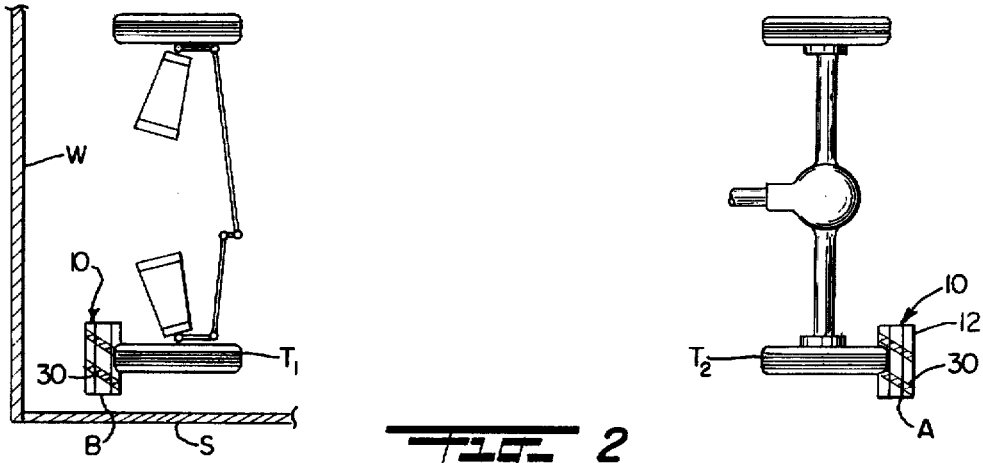
FIG. 2 is a top plan view, partially in section of the parking area with centering devices as illustrated in FIG. 1.
Figure 3:
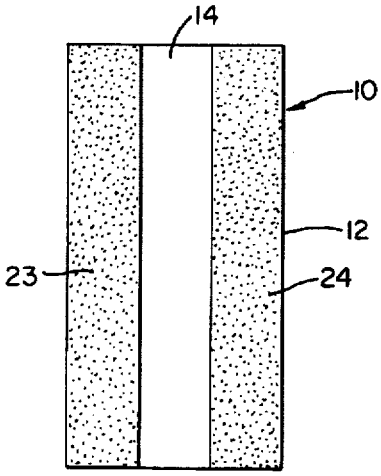
FIG. 3 is a top plan view enlarged of a preferred form of centering device.

Referring to the drawings in more detail, there is shown in FIGS. 1 to 3 a motor vehicle V parked on a floor surface F of a parking area. The parking area is schematically illustrated in the form of a garage G having a front end wall W and side wall S together with entrance area E. The garage is given more as a setting for the present invention and representative of innumerable types of parking areas or stalls in which it is important that the vehicle V be centered for utmost utilization of space and not crowd vehicles in adjacent spaces on either side of the parking space illustrated.

In the preferred form, the centering device 10 comprises a floor marker made up of a resilient body 12 of oblong configuration having a wide base surface 14, upwardly sloping side walls 16 which taper upwardly into a common upper flat surface portion 18 parallel to the base surface 14. The upwardly sloping walls are tapered at an approximate angle of 45° although it will become readily apparent that the precise angle may vary in that the cross-sectional configuration of the floor marker may vary so as to be of a somewhat rounded configuration, the important consideration being that the marker is of a height substantially less than a radius of a tire and such that the tire of a vehicle can easily roll over the marker but will create a sufficient jog or bump as to be sensed by the motor vehicle operator.

Figure 4:
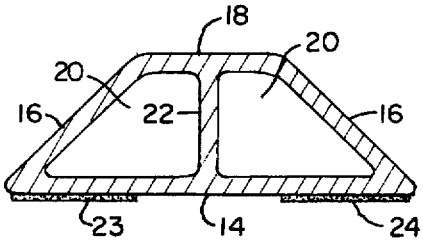
FIG. 4 is a cross-sectional view of the preferred form of centering device.

As best seen from FIG. 4, the body 12 may be hollow or solid but is preferably hollow and includes coextensive hollow areas or spaces 20 which run the length of the body and are divided by a common vertical web member 22 extending between the upper surface 18 and the base surface 14. In addition, each resilient body 12 includes securing means in the form of adhesive strips 23 and 24 disposed in closely spaced parallel relation to one another beneath and along the base surface 14 and extending the substantial length of the body. The strips 23 and 24 have adhesive material on their top and bottom surfaces adhesively secured to the undersurface of the base surface 14 and the floor surface F, respectively. Prior to installation, a suitable backing material, not shown, is affixed to the lower adhesive surface so that the body 12 may be temporarily positioned at the entrance area to the parking space and be shifted or moved until the proper location is determined whereupon the backing material may be removed from the adhesive strips and the body more permanently affixed at the desired location. There may be applications in which it is not desirable to permanently affix the body, such as, for residential use and in which even the adhesive may be more of a temporary or semi-permanent adhesive which will permit releasable attachment to the floor surface. For maximum adhesion the floor may be coated with a rubber cement for bonding to tthe strips 23 and 24; or an adhesive material may be applied directly to the undersurface of the body 12 in place of the strips 23 and 24.

As best seen from FIG. 2, each body 12 is provided with an outer coating 30 which is brightly colored or striped so as to be highly visible to the motor vehicle operator in approaching the parking space. Most importantly, the body 12 is positioned at location A designated in FIG. 2 at the entrance area E to the parking space and wherein the body 12 is oriented with its length extending transversely to the direction of travel of the motor vehicle into the parking space and in the path of travel of the left front tire T1, since the motor vehicle operator will have less difficulty in aligning the left front tire T1 with the body 12. When the tire, such as, the tire T1 contacts the body 12 it will be free to ride over the body and continue forwardly until it reaches the front body 12 after the rear left tire T2 has cleared the body 12 at location A. Thus, the second or front marker at location B adjacent to the front end wall W of the garage G is intended to act more as a stop to prevent the motor vehicle from colliding with the front wall or with articles that may be situated along the front wall. It will be evident, however, that the first device 10 at the location A may be utilized alone to serve both as a centering device and to warn the motor vehicle operator when the rear left tire T2 runs over the device 10 that contact with the front wall is imminent.

Preferably, the length of the centering device 10 is limited to a dimension at least as great as the width of the automobile tire and which dimension will define the degree of departure of the vehicle from center without overcrowding an adjacent space. For example, typical dimensions for a centering device would be to have a length of 18", a height on the order of 1.125" and a width on the order of 3.25". For the purpose of illustration and not limitation, the angle or slope of the side wall taper is approximately 45° and a preferred composition of the material is a flex PVC Compound No. 1200-90 manufactured and sold by Spartech Compounding of Kearny, N.J. Flexible PVC having a durometer of 50 up to 95. Also, for the purpose of illustration but not limitation, the strips 23 and 24 may be a cross-linked polyethylene foam and a typical adhesive for the foam strips 23 and 24 is a 4496 with A 30 material which exhibits good initial tack and ultimate adhesion to a variety of surfaces and is manufactured and sold by 3M of St. Paul, Minn. A typical outer coating 30 is made up of a yellow and black sticker sold under the trademark PRIMAX® by Fasson of Painesville, Ohio and which is covered with a clear polypropylene overlamination tape manufactured and sold by Sekisui Ta Industries, Inc. of Garden Grove, Calif. The use of adhesive strips has been found to be very advantageous in making up for inconsistencies in the floor surface and assuring a firm bond with the floor surface.

It is therefore to be understood that while preferred and modified forms of invention are herein set forth and described that the above and other modifications and changes may be made therein without departing from the spirit and scope of the present invention as defined by the appended claims and reasonable equivalents thereof.

We claim:

1. A parking space centering device for use in combination with a floor surface and contactable with a front tire of a motor vehicle to enable placement of the motor vehicle in predetermined relation to the floor surface comprising:

a resilient body of a length adapted to approximate a width of the tire and of a height adapted to be substantially less than a radius of the tire, and said body having side walls merging upwardly toward one another at approximately a 45° angle from a common base, an upper, substantially flat surface portion between said sidewalls and securing means for securing said body to said floor surface for extension transversely of the direction of travel of the motor vehicle and near an entrance end of said floor surface wherein movement of the from tire of the motor vehicle over said substantially flat surface portion of said body will establish alignment of the motor vehicle in predetermined relation to said floor surface.

2. A device according to claim 1 wherein said body has at least one inner hollow area extending the substantial length of said body.

3. A device according to claim 2 wherein said body includes a pair of said hollow areas and an intermediate vertical web portion between said hollow areas.

4. A device according to claim 1 wherein said base is substantially flat, and said securing means is defined by at least one adhesive strip extending the substantial length of said base.

5. A device according to claim 4 wherein said securing means includes a pair of adhesive strips in spaced parallel relation to one another along said base, each said strip having a top and bottom adhesive surface for adhesively securing said strip to said base and to said floor surface, respectively.

6. A device according to claim 1 wherein said body includes an outer coating of a highly visible marker material.

7. A device according to claim 1, further comprising another said body disposed in spaced, parallel relation to said first mentioned body at an opposite end of said floor space.

8. A stand-alone centering device for use in combination with a garage parking area having a floor surface with an entrance end and an opposite end wall, said device contactable with the tires on a motor vehicle whereby to enable parking of the motor vehicle in centered relation to a designated parking area on the floor surface, said centering device comprising:

at least one elongated body of a length adapted to be at least as great as a width dimension of a tire on the motor vehicle, said body adapted to be being of a height substantially less than that of the tire such that the tire will freely roll over said body, and said body having side walls tapering upwardly toward one another from a common base, an upper substantially flat surface portion between said side walls, and securing means for securing said body to said floor surface for extension transversely of the direction of travel of the motor vehicle and substantially at an entrance end of said floor surface whereby successive movement of a left front tire of the motor vehicle followed by a left rear tire of the motor vehicle over said substantially flat surface portion of said body will establish alignment of the motor vehicle in predetermined relation to said floor surface and said opposite end wall, said securing means including a pair of adhesive strips in spaced parallel relation to one another along a length dimension of said base, each said strip having a top and bottom adhesive surface for adhesively securing said strip to said base and to said floor surface, respectively.

9. A device according to claim 8 wherein said body has at least one inner hollow area extending the substantial length of said body.

10. A device according to claim 8 wherein said body includes an outer coating of a highly visible marker material.

11. A device according to claim 8 wherein a pair of said bodies are adapted to be disposed in spaced parallel, fore and aft relation to one another at opposite ends of said floor surface.

12. A stand-alone centering device for use in combination with a garage parking area having a floor surface with an entrance end and an opposite end wall, said centering device contactable with the tires on a motor vehicle whereby to enable parking of the motor vehicle in centered relation to a designated parking area on the floor surface, said centering device comprising:

a plurality of resilient floor markers including a first floor marker adapted to be located at said entrance end and adapted to be aligned with one of the front tires of the motor vehicle approaching said parking area, and a second floor marker adapted to be aligned in spaced parallel relation to said first floor marker and adapted to be at a predetermined distance from said opposite end wall whereby one of the front tires will roll over said first marker and advance forwardly into engagement with said second marker, each of said first and second markers comprising a low-profile resilient body of a length adapted to be at least as great as a width dimension of the tire and of a height such that the tire will freely roll over said body with minimal tilting of the motor vehicle, said body having securing means for adhesively securing said body to said floor surface.

13. A device according to claim 12 wherein said resilient body is of a width over twice its height and includes an intermediate vertically extending web extending lengthwise through a hollow interior of said body.

* * * * *